United States Patent [19]

Proulx et al.

[11] Patent Number: 4,590,840

[45] Date of Patent: May 27, 1986

[54] FLASH HOLE CLOSURE FOR PRIMER BATTERY CUPS

[75] Inventors: Richard W. Proulx, Forest Lake; Stephen J. Kent, Anoka, both of Minn.

[73] Assignee: Federal Cartridge Corporation, Minneapolis, Minn.

[21] Appl. No.: 669,775

[22] Filed: Nov. 9, 1984

[51] Int. Cl.[4] ..... F42B 5/02; F42B 9/02

[52] U.S. Cl. ..... 86/10; 86/12; 102/204; 102/470

[58] Field of Search ..... 86/10, 11, 12; 102/204, 102/470, 283, 292; 29/1.3

[56] References Cited

U.S. PATENT DOCUMENTS

| | | | |
|---|---|---|---|
| 2,708,878 | 5/1955 | Eckstein | 86/10 |
| 2,940,352 | 6/1960 | Grow, Jr. | 86/10 |
| 3,352,240 | 11/1967 | Eckstein | 102/45 |
| 3,363,563 | 1/1968 | Eckstein | 102/45 |
| 4,029,015 | 6/1977 | Lachaussee et al. | 102/45 |
| 4,383,469 | 5/1983 | MacMillan | 86/10 |

FOREIGN PATENT DOCUMENTS

| | | | |
|---|---|---|---|
| 0056190 | 7/1982 | European Pat. Off. | 86/10 |

*Primary Examiner*—Stephen J. Lechert, Jr.
*Assistant Examiner*—Howard J. Locker
*Attorney, Agent, or Firm*—Schroeder & Siegfried

[57] ABSTRACT

Apparatus and method for covering flash holes in a primer battery cup where the anvil is formed integrally with the battery cup. A tooling apparatus including a tubular foiling pin, and a cutting die plate which, in cooperation with the outside rim of the primer battery cup, blanks out an imperforate, covering-medium disk. As the tubular foiling pin continues to descend into the battery cup, the paper is pierced and slit by the anvil point of the battery cup. The blanked and now perforated disk is inserted further into the battery cup by the foiling pin and seated over the flash holes at the bottom of the cup around the anvil.

16 Claims, 6 Drawing Figures

FLASH HOLE CLOSURE FOR PRIMER BATTERY CUPS

DESCRIPTION

1. Field of the Invention

The present invention relates to primers for small arms amunition which have flash holes. More specifically, the present invention relates to covering the flash holes in a primer assembly where the battery cup and the anvil have been formed integrally.

2. Background of the Invention

Conventional primers for small arms ammunition usually include a primer cup, an anvil and a battery cup. The primer cup contains an impact sensitive, explosive priming mixture for igniting the propellant powder charge of the ammunition cartridge. The battery cup serves as a support for the anvil and primer cup and contains at least one flash hole. The flame and heat produced by the detonation of the priming mixture upon impact of a firing pin on the anvil will travel through the flash hole to ignite the propellant powder.

Flash holes and conventional primers may or may not be covered. Covering is not required where the flash hole is smaller than the grain size of the propellant powder. However, it is usually advantageous to cover the flash hole to allow the use of smaller grain sized powders. Covered flash holes prevent the explosive priming mixture from dusting out of the primer after it has been charged and also reduces hazards in handling.

A closed flash hole prevents propellent powder from entering the priming mixture chamber. Fine grain propellent powder may then be used without having powder sift into the battery cup through an open flash hole. A mixture of propellants within the battery cup is undesirable since ignition of powder within the cup could cause excessive pressure, resulting in malfunctions such as blowing the primer cup away from the battery cup.

The potential for flame-induced mass detonation of primers packed in bulk is significantly reduced by the covered flash hole construction. Mass detonation is an almost instantaneous chain reaction type of explosion which can occur when one primer is ignited which in turn ignites adjacent primers. Covered flash holes prevent the flame of an accidentally ignited primer from entering adjacent primers and thus reduces the risk of mass detonation.

The preferred primer for shot shells has an anvil and battery cup which are formed integrally from a single piece of metal. An example of such an integral anvilled battery cup primer is described in U.S. Pat. No. 4,029,015 granted on June 14, 1977 to M. Lachaussee and A. Maigret. The integral construction includes multiple flash or vent holes at the bottom of the battery cup arranged around an axially and outwardly extending pressed part forming the anvil. Because the anvil is integral with the battery cup and also because the anvil is shaped like a fluted cone, covering the multiple flash holes in this type of primer has presented unusual problems which were not present with conventional primers.

A method and device for covering primer flash holes in integral anvilled battery cups is disclosed in U.S. Pat. No. 4,383,469 granted on May 17, 1983 to John T. MacMillan. A spring loaded lancing punch is positioned in axially slidable relation within an outer punch. The sharp lancing punch preslits the covering material which is thereafter punched out in disk form by the outer punch. The pierced disk is then seated within a lower positioned battery cup. The lancing punch abuts against the flattened top of the integral anvil of the battery cup while the outer punch continues to descend. In another embodiment designed to prevent the lancing punch from dulling due to repeated contact with the blunt-headed anvils, a pin is added to the lancing punch to prevent the punch from contacting the anvil.

The alignment of the sharp lancing punch of the above MacMillan patent must be carefully maintained during the process. The alignment is achieved either by allowing the sharp punch to contact the flattened top of the anvil or by providing increased compression tension against the pin. If the anvil of the battery cup does not have a flattened upper surface, is rough, sloping or pointed, the sharp lance punch of MacMillan may slide off its top resulting in poor alignment of the apparatus. Also, the apparatus of MacMillan will not function properly if the integral anvil is not centered within the battery cup.

BRIEF SUMMARY OF THE INVENTION

The methods and apparatus of the present invention inserts a covering medium such as paper or foil into an anvilled battery cup containing one or more flash holes. The imperforate paper covering medium is first punched to form a disk. To accomplish this, the battery cup's outside rim is utilized as a punch in combination with a cutting die plate of the apparatus. A new punch is thereby automatically provided for each foil blank, such that the only wearing part in the tool is the cutting die plate. After the disk has been blanked, the foil or paper disk is carried on the tubular foiling pin into the battery cup. The centrally disposed point of the integral anvil contacts the disk as it is being inserted, causing the paper to be pierced. The tubular foiling pin continues to descend into the battery cup around the anvil and seats the now pierced paper disk into the bottom of the battery cup around the integral anvil.

Alignment is maintained during the disk-blanking step by positioning the battery cups within a carrier positioned directly below the tubular foiling pins. The tubular foiling pins are not required to contact the anvil points during the process. Instead, the tubular foiling pins pass over the conical anvil and are self-aligned by the walls of the battery cups.

Since piercing of the imperforate paper disk is achieved through the use of an integral anvil point, there is no sharp machine point which may be dulled after repeated use. Each battery cup itself is used as a punch for blanking and later piercing. Positioning is not dependent upon using a flattened anvil top to stop a lancing punch. The use of battery cups having imperfectly formed anvils will not damage the foiling pin of this invention as is the case with lancing punch devices.

BRIEF DESCRIPTION OF THE DRAWINGS

A detailed description of one preferred embodiment of the invention is hereafter described with specific reference being made to the drawings in which.

DETAILED DESCRIPTION OF THE INVENTION

Figure 1:
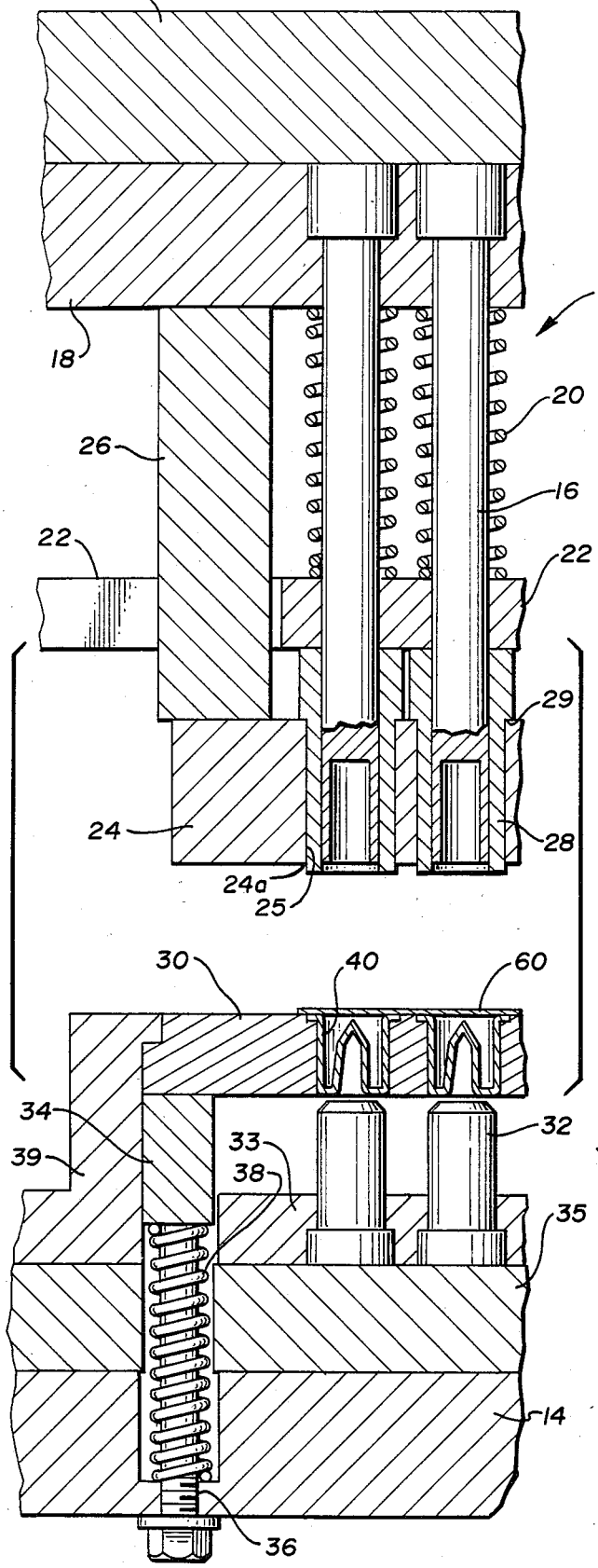
FIG. 1 is a cross-sectional view of a tooling apparatus of the invention for covering the flash holes of an anvilled battery cup.

The apparatus 10 of the present invention is illustrated in the cross sectional view of the work station of FIG. 1. The apparatus is set in a die comprising an upper die shoe 12 and a lower die shoe or backing plate 14. The entire die may include multiple stations for indexing and delivering primer battery cups to the work station.

A tubular foiling pin 16 is set within a foiling pin holder 18 fixedly attached to the upper die shoe 12. A spring 20 is positioned axially around the upper portion of the tubular foiling pin 16 between foiling pin holder 18 and a stripper plate 22 so as to spring bias stripper plate 22, and stripper bushing 28 downward. Cutting die plate 24 is fixedly secured to die plate guide 26 which is in turn fixedly attached to foiling pin holder 18. Stripper plate 22 engages stripper bushing 28 such that the vertical movement of bushing 28 causes stripper plate 22 to be urged against springs 20. Shoulder 29 of stripper bushing 28 rests against cutting die plate 24 due to the pressure of spring 20 exerted through stripper plate 22. Shoulder 29 prevents bushing 28 from slipping out of the guide holes 25 of cutting die plate 24. The cutting die plate 24, in combination with stripper bushings 28, aligns and positions individual tubular foiling pins 16 with respect to the upper die shoe 12.

A battery cup plate or carrier 30 is located adjacent the lower backing plate 14 and transports anvilled battery cups to the work station. Each battery cup 40 is positioned within an opening in the carrier 30 and is oriented so that its open end faces foiling pin 16.

Positioned directly below carrier 30 are a plurality of battery cup support pins 32. Each battery cup support pin 32 is aligned directly beneath a battery cup positioned in battery cup plate 30. Support pin plate 33 holds and positions pins 32 to lower die member 35.

Figure 2:
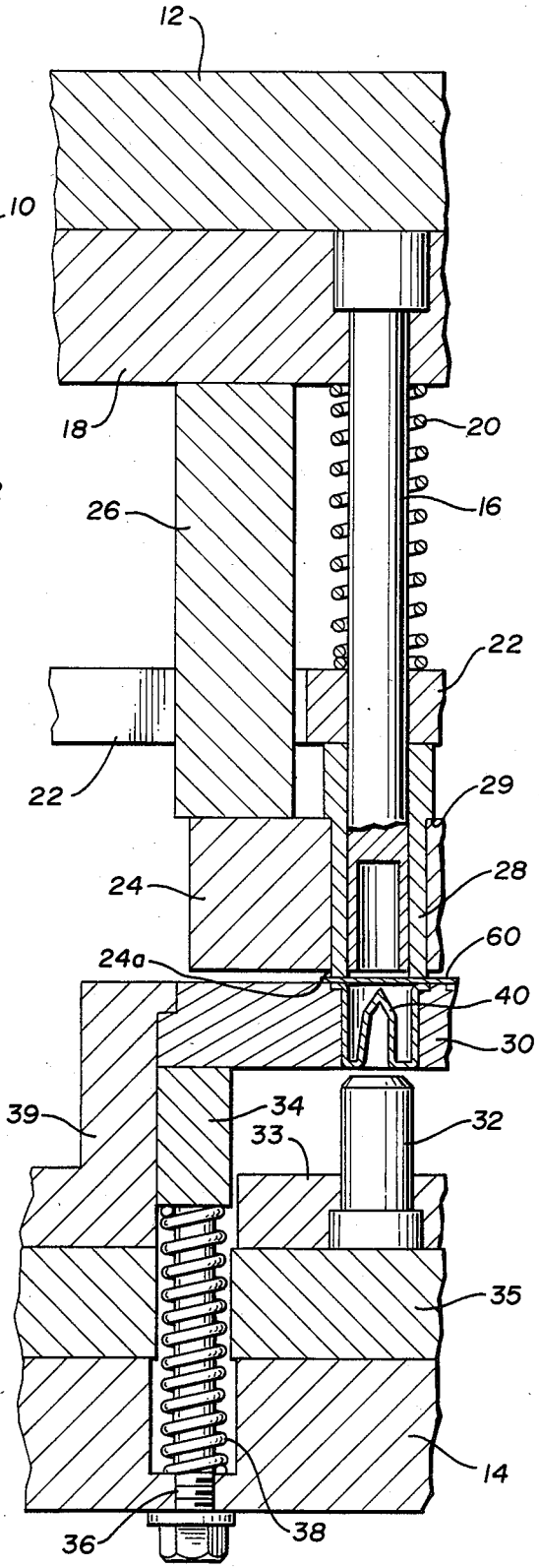
FIGS. 2 through 4 are cross sectional views illustrating the progressive stages of the tooling apparatus of FIG. 1 in blanking, piercing and seating imperforate paper over the flash holes.
Figure 3:
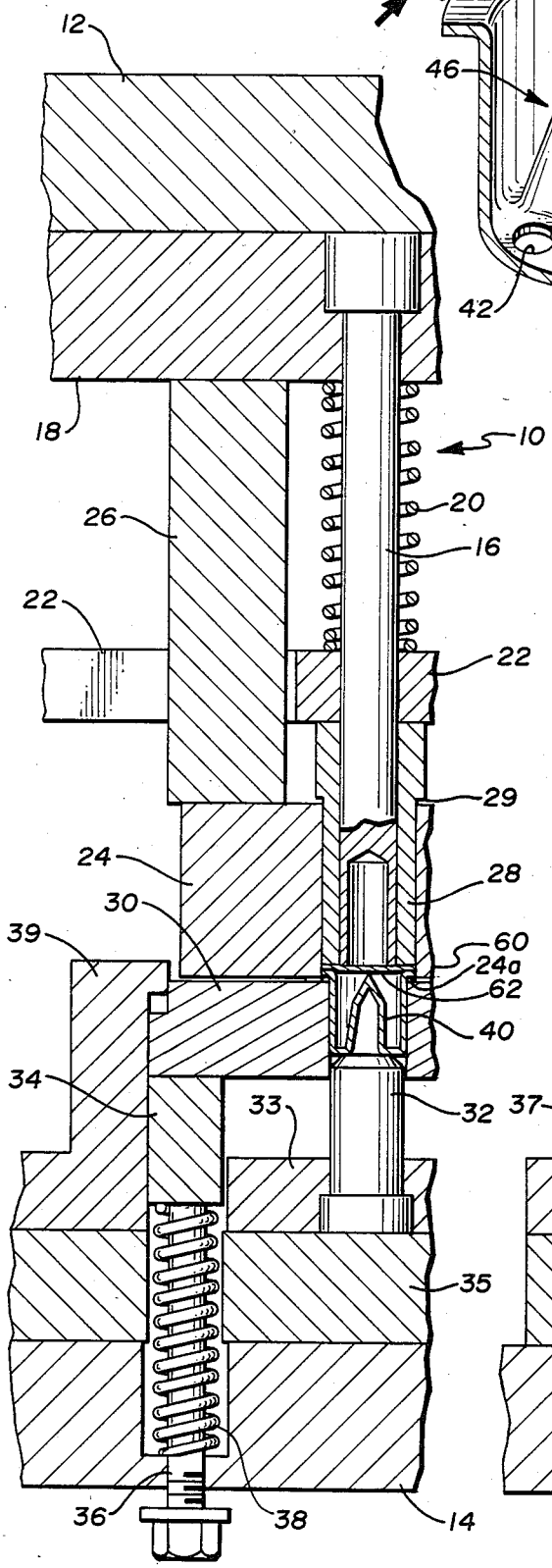
Figure 4:
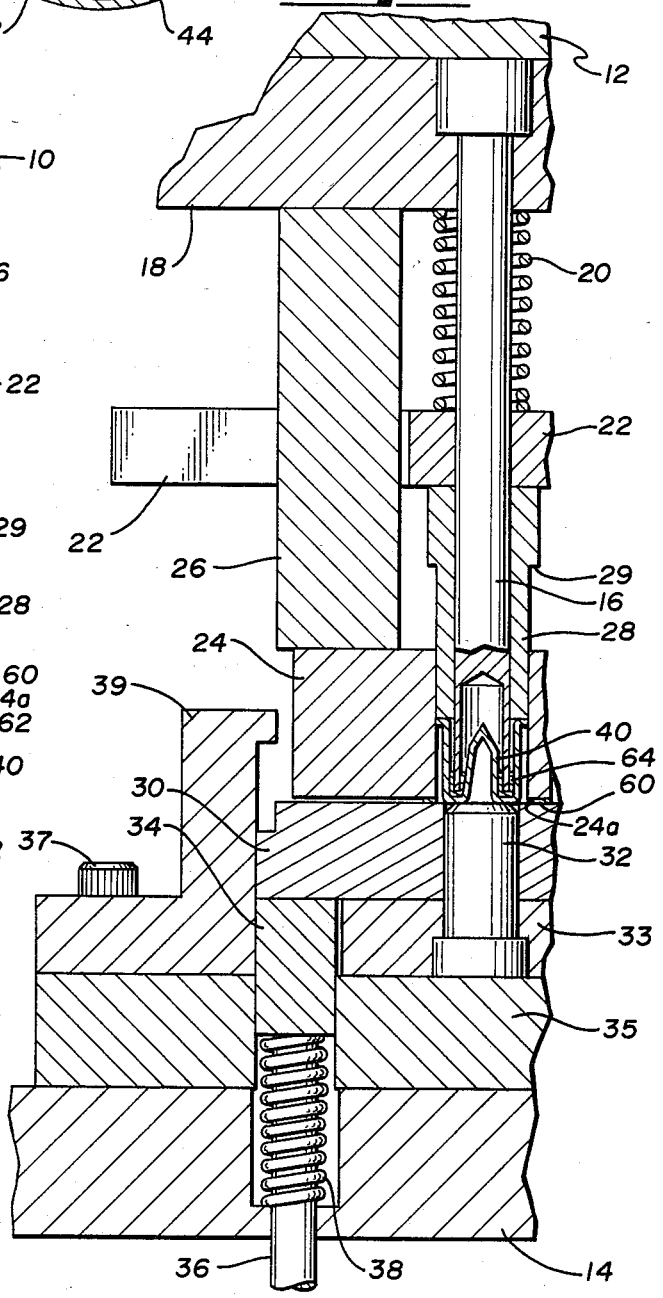

Battery cup plate 30 is supported on the lower backing plate 14 by cup plate support bars 34. Cup plate support bars 34 include threaded bolts 36 which extend downwardly through the lower backing plate 14 as shown in FIG. 1. A spring 38 is positioned axially over threaded bolts 36 between a cup plate support bar 34 and lower backing plate 14 so as to spring bias the former upwardly. In this manner, carrier plate 30 may be held above the battery cup support pins 32 or may be allowed to descend onto the battery cup lift pins as in FIGS. 2–4. Upward movement of carrier plate 30 is limited by carrier stops 39. As carrier plate 30 is depressed downwardly, cup plate support bar 34 descends causing its fixedly attached bolts to slide through the lower backing plate 14 as shown in FIGS. 2–4. Spring 38 compresses between support bar 34 and lower backing plate 14 when carrier 30 is depressed. Carrier stops 39 and lower die member 35 are fixedly secured to lower backing plate 14 by bolt 37 as shown in FIG. 4.

Battery cups 40 comprise a tubular cylindrical chamber open at the top and having three flash holes 42 located peripherally at the otherwise closed bottom end 44. The anvil is shaped like a fluted cone and extends outwardly from and is integral with the bottom of the cup. The anvil 46 has a lower portion 48 which is generally conical and an upper portion 50 which is tapered and also generally conical. Upper portion 50 presents a point or piercing edge 52.

Figure 5:
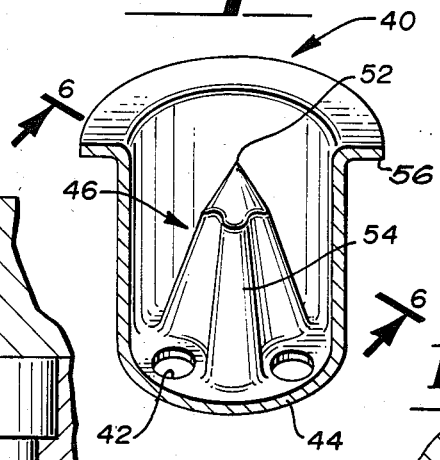
FIG. 5 is a partial perspective view of the anvilled battery cup used with the tooling apparatus of the invention.
Figure 6:
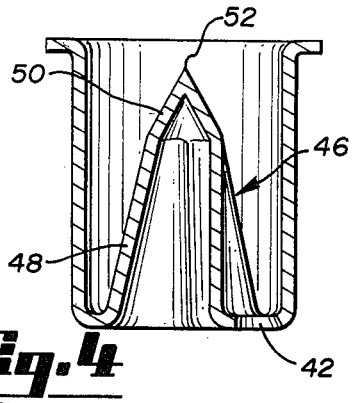
FIG. 6 is an axial cross-sectional view of the anvilled battery cup of FIG. 5 taken along line 6—6 of FIG. 5.

Lower portion 48 of the anvil has grooves or radial stiffening ribs 54 extending along three diametrical planes at about 120° from each other as shown in FIGS. 5 and 6. The ribs are parallel to the longitudinal axis of the anvil 46 along the lower portion 48. The rib depth is at its maximum at the bottom of the battery cup and decreases to zero at the upper tapered portion 50. The flash holes 42 are located at the bottom 44 where the rib depth is at its maximum. Battery cups 40 also include an annular rim 56 as shown.

The above described battery cup 40 is constructed in a process similar to that described in U.S. Pat. No. 4,029,015 to Lachaussee et al. However, for the apparatus and processes of this invention, any battery cup having an integral anvil may be utilized so long as the apex of the anvil presents a point or piercing edge which will perforate the covering material employed.

The upper die shoe 12 has a downward stroke sufficient to bring the lower end of the tubular foiling pins 16 downward into the bottom of the anvilled battery cups 40. As the upper die shoe 12 begins to move down due to pressure from a conventional ram, a covering material 60 formed from paper foil or a similar materials inserted on top of battery cup plate 30 is contacted. The battery cup 40 is maintained in aligned position throughout the process by battery cup plate 30. Continued downward pressure exerted from upper die shoe 12 causes the cutting die plate 24 to contact and depress battery cup plate 30. This causes spring 38 to compress as shown in FIGS. 2 through 4. At the same time, the tubular foiling pin 16, which has an outside diameter less than the inside diameter of the battery cups 40, begins to enter the battery cup. The outer periphery of battery cup rim 56 acts as a punch which cooperates with the cutting edge of **24*a* of cutting die plate 24 to punch or blank out an imperforate covering material disk 62 as shown in FIG. 3. Battery cups 40 are held in alignment by bushing 28 and guide holes 25 of cutting die plate 24**.

As shown in FIGS. 2 through 4, battery cups 40 did not descend downwardly with the battery cup plate 30 due to the underlying battery cup support pins 32. Continued downward movement of the upper die shoe 12 and the tubular foiling pin 16 causes the imperforate covering material disk to contact the battery cup anvil point 52 which causes same to be pierced. The tubular foiling pin 16 continues to move downwardly in the battery cup and inserts the now perforated disk until it is seated at the closed, bottom end 44 of the battery cup 40. The tubular construction of the foiling pin 16 allows the foiling pins to pass directly over the anvils without engaging anvil point 52.

In FIG. 4, further downward movement of the tubular foiling pin 16 is prevented when it reaches closed bottom end 44 of the battery cups. As shown, stripper bushing 28 continues to apply downward pressure onto battery cup rims 56 by virtue of the action of spring 20 upon stripper plate 22 maintaining proper alignment of the cups within the die plate 24.

Tubular foiling pin 16 firmly seats the perforated covering material disk 64 at the base of the anvil by compressing the covering material between the anvil ribs 54 and a battery cup interior wall. Flash holes 42 located at the bottom of the cup are substantially completely covered by the covering material. The die shoe 12 is then raised to the top of its stroke allowing the foil covered battery cups to be ejected from the cutting die plate 24. The battery cup plate 30 may then be removed. The foiled battery cups may be removed from the battery cup plate 30 or the filled plate 30 may be utilized in the next stage of primer preparation. A new battery cup plate 30 fitted with uncovered battery cups is then repositioned in the apparatus 10 in order to repeat the procedure.

The only wearing parts in apparatus 10 are the die cutting plate and foiling pin. The use of the battery cup rim as the punch for blanking the foil disk means that a new punch is used for each foil blank. Likewise, the use of the anvil point to perforate the imperforate, blanked foil disk provides an apparatus which has no wearing part used for piercing the covering material.

The apparatus and methods of the invention provide a covering over flash holes in primer battery cups which prevents the explosive priming mixture and propellent powder from mixing and reduces downtime due to the unique properties of the design. The only wearing parts are the foiling pins, cutting die plates, the battery cup rims and anvils. Since the battery cups are only used once, fewer parts must be replaced due to wear. The tubular foiling pin may be used over many more cycles before needing replacement, unlike devices employing central lancing punches.

Any battery cup having an integral anvil which presents a pointed edge or cutting edge which will cut the covering material may be utilized in the methods and apparatus of the invention.

The apparatus of the invention performs the flash hole covering process with less down-time, fewer replacement parts and lasts longer than devices which include lancing punches and blanking dies. The invention will perform well on battery cups having sharp, flat or imperfectly formed anvils. Therefore, the percentage of defective battery cup primers produced is also reduced by the novel features of the inventions.

In considering this invention, it should be remembered that the disclosure is illustrative only and that the scope of the invention is to be determined by the appended claims.

What is claimed is:

1. An apparatus for covering flash holes formed in the closed end of a tubular primer battery cup open at the other end, said tubular primer battery cup having an anvil integral with the closed cup end and extending outwardly therewithin so as to present a centrally disposed pointed end adjacent the open end of the battery cup, the apparatus comprising:

(a) tooling means including a cutting die plate having a circular cutting opening therein with a cutting edge substantially equal in diameter to the external diameter of the rim of the battery cup, a stripper bushing axially slidable within said dieplate opening and having external diameter substantially equal to the external diameter of the rim of the battery cup to cooperate therewith in holding a covering means therebetween as the battery cup rim is moved into said die plate opening and a tubular foiling pin axially slidable within said bushing and having an external diameter less than the internal diameter of such a battery cup and an internal diameter greater than the outside diameter of an anvil of such a battery cup and constructed and arranged to be controllably moved vertically such that said pin may function in telescoping cooperation with such a battery cup anvil to thereby pierce a disk with the latter and move the disk into covering relation with the flash holes in the battery cup;

(b) carrier means for transporting such a primer battery cup to a position directly opposite said tooling means with its open end facing and aligned with said cutting opening; and (c) covering means positioned between said tooling means and said carrier means whereby the vertical movement of said tooling means will cause said cutting die plate and such a battery cup rim to cooperatively punch an imperforate disk equal in diameter to the external diameter of the battery cup rim from said covering means, and said foiling pin to carry the punched, imperforate disk portion of said covering means into the battery cup to said anvil point where it will be pierced solely by said anvil point, and pressed into the open end of the battery cup and seated at its closed end due to the vertical movement of said tooling means.

2. The apparatus of claim 1 wherein said carrier means includes a battery cup plate having a plurality of perforations therethrough, said perforations having a diameter less than the diameter of a rim of such battery cups and larger than the diameter of the tubular portion of such cups so as to carry and align such battery cups.

3. The apparatus of claim 2 further including a plurality of battery cup support pins positioned directly opposite each of said battery cup plate openings, said pins having a diameter slightly less than the diameter of said openings and said pins having an upper surface for supporting the closed cup ends of such battery cups.

4. The apparatus of claim 1 wherein a stripper bushing is positioned around said tubular foiling pin and slidable axially therealong, said stripper bushing being mounted at one end in a die means adapted to move vertically, the downward movement of said die means causing one end of said stripper bushing to apply pressure to the rim of such battery cups so as to maintain the alignment of same and to hold the covering means in position for blanking by the battery cup rims.

5. The apparatus of claim 3 wherein said battery cup plate is constructed and arranged to move vertically due to pressure from said tooling means until a lower limit is reached, thereby limiting the depth said tubular foiling pin will reach within the interiors of such battery cups.

6. An apparatus for covering flash holes formed in the closed end of a tubular rimmed primer battery cup open at the other end, said tubular primer battery cup having an anvil integral with the closed cup end and extending outwardly therewithin so as to present a centrally disposed pointed end adjacent the open end of the battery cup, the apparatus comprising:

(a) tooling means including a cutting die plate having a circular cutting opening therein with a cutting edge substantially equal in diameter to the external diameter of the rim of the battery cup, a stripper bushing axially slidable within said die plate opening and having external diameter substantially equal to the external diameter of the rim of the battery cup to cooperate therewith in holding a covering means therebetween as the battery cup rim is moved into said die plate opening and a tubular foiling pin axially slidable within said bushing and having an external diameter slightly less than the internal diameter of such a battery cup and an internal diameter greater than the outside diameter of an anvil of such a battery cup and constructed and arranged to be controllably moved vertically such that said pin may function in telescoping cooperation with such a battery cup anvil to thereby pierce a disk with the latter and move the disk into covering relation with the flash holes in the battery cup;

(b) carrier means for transporting such a primer battery cup to a position directly opposite said tooling means with its open end facing and aligned with said cutting opening; and (c) said tooling means and said carrier means being constructed and arranged so that when said covering means is positioned between said tooling means and said carrier means, the vertical movement of said tooling means will cause said cutting die plate and such a battery cup rim to cooperatively punch an imperforate disk equal in diameter to the external diameter of the battery cup rim from said covering means, and will cause the punched, imperforate disk portion of said covering means to be carried into the battery cup by said tubular foiling pin to said anvil point where it will be pierced solely by said anvil point and pressed into the open end of the battery cup and seated at its closed end to cover the flash holes at such closed end due to the vertical movement of said tooling means.

7. The apparatus of claim 6 wherein said carrier means includes a battery cup plate having a plurality of perforations therethrough, said perforations having a diameter less than the diameter of a rim of such battery cups and larger than the diameter of the tubular portion of such cups so as to carry and align such battery cups.

8. The apparatus of claim 7 further including a plurality of battery cup support pins positioned directly opposite said battery cup plate perforations, said pins having a diameter slightly less than the diameter of said perforations and said pins having an upper surface for supporting the closed cup ends of such battery cups.

9. The apparatus of claim 6 wherein said tooling means includes a stripper bushing positioned around each of a plurality of tubular foiling pins in axially slidable relation about said pins, said stripper bushings being mounted at one end in a die means constructed and arranged to move vertically, the downward movement of said die means causing one end of said stripper bushings to apply pressure to the rim of such battery cups so as to maintain the alignment of same and to hold the covering means in position for blanking by the battery cup rim.

10. The apparatus of claim 8 wherein said battery cup plate is constructed and arranged to move vertically due to pressure from said tooling means until a lower limit is reached to thereby limit the depth said tubular foiling pin will reach within the interiors of such battery cups.

11. An apparatus for covering flash holes formed in the closed end of a tubular primer battery cup open and rimmed at the other end and having an integrally formed generally conically shaped anvil extending outwardly therewithin from its closed end and constructed and arranged such that the apex of the anvil presents a cutting edge extending upwardly towards said open, rimmed end; the apparatus comprising:

(a) carrier means for carrying such primer battery cups with their open ends facing upwardly;

(b) tooling means carrying vertically movable punch means, said punch means including tubular punches constructed and arranged such that said punches have external dimensions less than but approaching the internal dimensions of such battery cup and having an internal dimension greater than the external dimension of an anvil of such cup and may be inserted into such cups to a position adjacent their closed ends without engaging their anvils, said tooling means transporting the punches into and out of the interiors of such battery cups carried by said carrier means;

(c) said carrier means, tooling means and tubular punch means being constructed and arranged to cause the battery cups to telescope into said tooling means so that a covering means placed between said tooling means and carrier means will be punched out in the form of an imperforate disk by the telescoping of said battery cup rims, said punch means being further constructed and arranged to carry the imperforate punched portions downwardly around the anvil apexes in pierced relation and to insert and seat the same against the closed end of the battery cup to thereby cover the flash holes at its closed end.

12. The apparatus of claim 11 wherein said carrier means includes a carrier plate having a plurality of perforations therethrough, said perforations having a diameter slightly larger than the tubular portion of such battery cups and a diameter smaller than the diameter of the rims of such cups.

13. The apparatus of claim 11 wherein said punch means further includes tubular bushings positioned around each of said punches in axially slidable relation thereto, said tubular bushings having a lower end substantially equal in size to the external diameter of the rims of such battery cups so as to engage the rim of such battery cups positioned within said carrier means and maintain the alignment of such cups and firmly secure the covering means in position during the punching of same by the telescoping battery cup rims.

14. The apparatus of claim 13 wherein said tubular bushings are urged downwardly toward said carrier means by spring means.

15. A method for covering flash holes formed in the closed end of a conventional tubular primary battery cup open at the other end and having an anvil integral with the closed end and extending outwardly and centrally therewithin so as to present a centrally disposed pointed end adjacent the open end of the battery cup, consisting in:

(a) transporting the battery cup to a position directly opposite the cutting opening of a cutting plate with the open end of the cup facing that opening, the open end of the cup having a diameter equal to that of the opening;

(b) providing a covering medium between the battery cup and cutting plate;

(c) forcing the battery cup through the covering medium and into the opening of the cutting plate while using the battery cup rim as a punch and thereby blanking an imperforate disk from the covering medium;

(d) piercing the imperforate disk with the anvil point by forcing the same onto the anvil point and into the cup; and (e) seating the disk at the closed end of the battery cup in covering relation with its flash holes.

16. The method of claim 15, and holding the covering medium between the battery cup rim and a tubular bushing positioned in slidable axial relation within the opening of the cutting plate while the battery cup is forced upwardly through the covering medium.

* * * * *